FIP7811 XR 4,077,670

United States Patent [19]

Spies et al.

[11] 4,077,670

[45] Mar. 7, 1978

[54] METHOD AND APPARATUS FOR ADVANCING AND SUPPORTING AN UNDERGROUND MINE GALLERY

[75] Inventors: Klaus Spies, Dortmund-Persebeck; Günter Blumental, Westerhold; Karlheinz Bohnes; Peter Marr, both of Bochum, all of Germany

[73] Assignee: Bochumer Eisenhutte Heintzmann GmbH & Co, Bochum, Germany

[21] Appl. No.: 793,277

[22] Filed: May 3, 1977

[30] Foreign Application Priority Data

May 15, 1976 Germany ..... 2621674

[51] Int. Cl.[2] ..... E21D 9/08; E21D 11/18

[52] U.S. Cl. ..... 299/11; 299/13; 299/33; 61/84

[58] Field of Search ..... 299/11, 13, 31, 33; 61/84, 85

[56] References Cited

U.S. PATENT DOCUMENTS

| | | | |
|---|---|---|---|
| 3,266,845 | 8/1966 | Williamson et al. | 299/13 X |
| 3,511,538 | 5/1970 | Guenter | 299/13 |
| 3,675,433 | 7/1972 | Silvestrov et al. | 61/84 |

FOREIGN PATENT DOCUMENTS

| | | | |
|---|---|---|---|
| 6,716,764 | 6/1968 | Netherlands | 299/33 |

*Primary Examiner*—Ernest R. Purser
*Attorney, Agent, or Firm*—Michael J. Striker

[57] ABSTRACT

A method for advancing and supporting an underground mine gallery in which a groove following the outline of the cross-section of the mine gallery is formed in the mine face and simultaneously thereto a plurality of bore holes are drilled in the part of the mine face located inwardly of the groove, in which a support frame is then placed into the groove and braced against the surrounding rock, whereafter explosives placed in the bore holes are exploded to remove the part inwardly of the groove from the mine face, while the loose material formed during the preceding steps is transported away from the mine face; and a machine for carrying out the method which is advanced after the above-mentioned steps are performed, whereafter the above-mentioned steps are repeated to thus advance the underground mine gallery while properly supporting the same during such advance.

10 Claims, 8 Drawing Figures

METHOD AND APPARATUS FOR ADVANCING AND SUPPORTING AN UNDERGROUND MINE GALLERY

BACKGROUND OF THE INVENTION

The present invention relates to a method for advancing and supporting an underground mine gallery in which the contour of the cross-section of the mine gallery is produced by a mining machine and in which the cross-section of the mine gallery is held open and supported by a plurality of support frames arranged spaced from each other in the longitudinal direction of the mine gallery in which the support frames may eventually yield to a limited degree under the pressure of the surrounding rock.

On the other hand, the invention also relates to a machine, as well as to support frames for carrying out the method.

Machines for advancing an underground mine gallery are known, which are used to cut minerals from the whole mine face to thereby obtain the desired contour of the mine gallery. The tools of such machines cut thereby substantially the complete mine face. Such machines and the operation thereof are not only very expensive, so that their use is only warranted during advancing of mine galleries for a considerable length, but in addition thereto, due to the construction of such mining machines, it is possible to place support frames only at a distance from the portion of the mine gallery which is opened at any instant by the mining machine. Depending on the structure of the surrounding rock, such a delay of proper support may lead to dangerous situations. Furthermore, the cross-section of an underground mine gallery produced by a full-cut mining machine is usually limited to a circular form. In addition, considerable difficulties are encountered to insert and properly set the usually trough shaped, and under the pressure of the surrounding rock slightly yieldable, supports parallel to the continuous advance of such a full-cut mining machine.

Advancing mining machines are also known which cut only successive parts from the mine face, by means of which, however, it is not possible to produce an exact contour of the desired cross-section of the mine gallery. Due to the kinematics of such machines, sawtooth shaped profiles and irregular breaks are produced in the thus formed walls of the mine gallery, which requires a backfilling in order to assure a proper abutment of the support means against the surrounding rock. It is further of disadvantage that delay of proper support of the freshly formed portion of the underground mine gallery cannot be avoided since such supports can be put in place only after all of the loose material formed during the cutting operation is transported away from the mine face. The stability of the surrounding rock is therefore necessarily impaired.

The above mentioned disadvantages are also present when the mine gallery is advanced by a boring-and-blasting operation.

In connection with the known methods for advancing a mine gallery and the thereby used means, considerable difficulties are also encountered to properly correlate the advancing or mining operation, on the one hand, with the supporting operation, on the other hand, so that as many as possible operations can be carried out simultaneously, in order to maintain the speed at which the underground mine gallery is advanced within an economically affordable range.

SUMMARY OF THE INVENTION

It is an object of the present invention to provide a method, as well as a machine, for advancing and properly supporting an underground mine gallery, which avoids the disadvantages of such methods and machines known in the art.

It is a further object of the present invention to provide a method and machine of the aforementioned kind, in which a great number of the necessary steps for advancing and supporting an underground mine gallery can be carried out simultaneously, while maintaining the surrounding rock of the mine gallery properly supported, so as to increase the speed of advancing the mine gallery beyond such speeds which are obtainable with methods and machines known in the art.

It is a further object of the present invention to provide for support frames especially adapted for carrying out the method according to the invention.

With these and other objects in view, which will become apparent as the description proceeds, the method for advancing and supporting an underground mine gallery mainly comprises the steps of producing in the mine face, along the contour of the cross-section of the mine gallery, a groove having a depth corresponding substantially to the distance between two support frames and a width greater than the height of a profile of a frame, simultaneously drilling into the part of the mine face, located inwardly of the groove, a plurality of bore holes while transporting at the same time loose material produced by the aforementioned operations away from the mine face, placing a support frame into the groove, bracing the support frame against the surrounding wall surface, connecting a prior set support frame to the one support frame, placing explosives into the bore holes, exploding the explosives to remove the part inwardly of the groove of the mine face while transporting loose material produced by the last step away from the mine face, advancing the machine in longitudinal direction of the mine gallery, and repeating all of the aforementioned steps.

The method according to the invention comprises therefore, on the one hand, the advantages of a full-cut mining machine with regard to the exact production of the contour of the desired cross-section of the mine gallery, and, on the other hand, the advantages of a partial-cut mining machine, respectively of a blasting method, considering that the machine for carrying out the method, as well as the therewith produceable method steps are considerably simpler as compared to a full-cut machine. Therewith the speed of advancing the mine gallery is considerably increased with a smaller amount of energy and less miners per work shift, as compared with methods knwon in the art. For the production of the aforementioned contour grooves it is only necessary to comminute about 30% of the total volume of the material to be removed from the mine face. The greater remaining volume of the mine face located inwardly of the contour groove is removed by blasting operations. These blasting operations have, due to the produced contour grooves, no influence of the stability of the surrounding rock. A further advantage of the contour groove is that the number of the bore holes to be produced is considerably reduced and especially bore holes at the contour of the mine gallery are avoided, which quite often create considerable problems.

The forming of a contour groove at the periphery of the desired cross-section of the mine gallery, which also can be made in any desired form, has the additional advantage that a support frame can be promptly placed into the groove and, due to the exact contour, be set in proper relationship against the surrounding rock. A delay in the proper support of the surrounding rock is thus greatly reduced, as compared to known methods which full-cut or partial-cut mining machines, respectively to a blasting operation and therewith the stability of the surrounding rock is greatly improved. The prompt erection of such support frames will likewise enhance the stability of the surrounding rock during the blasting operation of the part of the mine face located inwardly of the groove.

The method according to the present invention makes also a backfilling unnecessary since practically no material beyond the desired cross-section of the underground mine gallery is removed. The method steps for the production of the contour grooves, the forming of the bore holes in the part of the mine face located inwardly of the contour groove, the transport of the loose rock produced during forming of the contour groove and the bores holes and the preassembly of the support frames to be placed into the contour groove can be carried out substantially at the same time. A spacing of the necessary operation steps is practically only then necessary if required by laws applicable to mining operations. This is for instance the case during loading of the bore holes with explosives and subsequently igniting the explosives.

The machine for carrying out the method according to the present invention mainly comprises advanceable and arrestable elongated support means extending in longitudinal direction of the mine gallery and including frame means arched according to the contour of the mine gallery, groove forming means movably carried by the support means for cutting into the mine face a groove of predetermined width and depth along the contour of the mine gallery, guide means on the arched frame means for guiding the groove forming means along the contour, bore hole forming means, means connecting the bore hole forming means to the support means for locating the bore hole forming means at portions of the mine face located inwardly of the groove formed by the groove forming means and for advancing the bore hole forming means into the mine face, loading and conveyor means connected to the region of the support means adjacent to the sole of the mine gallery for transporting loose material produced during operation of the machine away from the mine face, means movable along the supporting means for transporting support frames toward the mine face, and means on said support means for positioning the support frames into the groove formed by the groove forming means.

The provision of arched frame means on the support means permits to adapt these elements which provide guide and support functions substantially to the form of the desired cross-section of the underground mine gallery and to bring these elements so close to the surrounding wall surface so as to provide within the arched frame means the necessary space for the arrangement and support of the elements which carry out the various steps of the method, as well as the necessary space for transporting the loose rock removed from the mine face away from the latter and the necessary space for the transport of support frames, which are preassembled rearwardly of the arched support frames, toward the mine face. The self-advancing support means make it possible that the tools for the production of the contour groove have to be only radially adjustable since the depth of the contour groove can be controlled and supervised by the walking support means. The construction of these tools and their mounting including their adjustability can thus be held very simple.

The groove forming tools are positively guided according to the desired contour in the region of the support means which is directed toward the mine face. The guiding of these tools may be performed by a stationary template, constructed in accordance with the desired cross-section of the underground mine gallery, or by direct controlling of these tools. The means for forming the bore holes are movable within the interior of the arched frame means and are thus independent from the groove forming tools. The forming of the contour groove and the boring of the bore holes can thus be carried out at the same time. The loading and conveyor means, connected to the region of the support means adjacent to the sole of the mine gallery, are constructed in such a manner that, during advancing of the support means towards the mine face, the loose rock produced during forming of the contour groove and during boring of the bore holes is automatically taken up and transported away from the mine face. The means for transporting and positioning the support frames permit to transport the preassembled parts thereof mechanically through the arched frame means toward the mine face and subsequently thereto to place combined halves of these support frames into the just-formed contour groove and to properly brace the frames against the surrounding rock.

In a preferred construction of the machine according to the present invention, the aforementioned support means comprise two coaxially arranged sections which are movable with respect to each other in the longitudinal direction of the mine gallery, a pair of transversely spaced wide skids on each of these sections, extensible and collapsible means connecting the sections to each other for moving the same relative to each other in the longitudinal direction of the mine gallery, and thrust means on each of the sections movable between an active position engaging portions of the surrounding wall of the mine gallery and an inactive position, for maintaining in said active position one of the sections stationarily while the other of the sections is moved relative thereto.

The extensible and collapsible means as well as the thrust means are preferably constructed as hydraulically operated cylinder-and-piston means. The thrust means permit a proper arresting of both sections within the mine gallery to assure thereby that the support means will form a proper abutment, especially for the groove forming and boring tools. The thrust means on one of the sections abut against the side walls of the mine gallery and thus permit also a correction of the direction of the support means and therewith also in a simple manner the formation of curved mine gallery sections. The coaxial position of both sections of the support means is maintained by appropriate guide rails which are preferably provided in the region of the support means adjacent to the sole of the mine gallery. The wide skids on the sections will assure a proper stability of the arrangement during the cutting and boring operations with small specific surface pressure against the sole of the mine gallery. The thrust means on the section adjacent the mine face are preferably arranged adjacent to the sole of the mine gallery and extend transverse to the longitudinal direction of the mine gallery, whereas in the other section the thrust means are preferably provided in a V-shaped arrangement between the skids and the roof of the mine gallery. The means for moving the sections relative to each other in longitudinal direction are preferably arranged, on the one hand, in the skids and, on the other hand, at or above the median height region of the longitudinal sections.

The groove forming tools may be formed in various different ways. For instance, it is possible to use such tools which operate with jets of water of high pressure. In a preferred form, these tools are constituted by a substantially conical milling cutter, mounted on a cantilever, which is turnable and tiltable with respect to a support member, which in turn is movable along guide means provided in the region of the support means facing the mine face. The guide means are constructed in such a manner that the support member, at a for instance U-shaped cross-section of the underground mine gallery, may be moved along the complete curved contour. The cantilever remains thereby with respect to the support member immovable. In the position of the support member at the sole of the mine gallery, the cantilever may, due to its turnable and tiltable mounting on the support member, be moved in such a direction that a groove portion along the sole of the mine gallery may also be formed at the mine face. The tilting of the cantilever with respect to the support member is preferably carried out by hydraulically operated cylinder-and-piston means. The support member can be provided with its own drive, but it can also be pulled by appropriate means along its guide and eventually be arrested, for instance during forming of the groove portion along the sole of the mine gallery. The support member is constructed in such a manner that it is flat and closely adjacent to the arched support frames so as not to limit the available free space within the latter. The drive for the milling cutter can be located within the cantilever.

The bore hole forming means preferably comprise a boring tool, telescoping mounting means carrying the boring tool, a slide, guide means connected to an upper portion of the arched frame means on which the slide is suspended movable in longitudinal direction of the support means, and a carrier arm turnable about an axis parallel to the elongation of the support means and tiltable with respect to said axis and connecting the mounting means to the slide. Hydraulically operated cylinder-and-piston means are provided between the carrier arm and the slide for tilting the carrier arm so that the telescopic mounting means may extend parallel to the longitudinal direction of the mine gallery or at an angle inclined thereto. The carrier arm may be turned with respect to the slide by means of a hydraulically operated tilt motor, mounted in the slide.

According to a further feature of the machine of the present invention, the loading and conveyor means are substantially T-shaped and have two laterally extending wings at a front end portion thereof, provided with forwardly extending loading ramps, and an elongated portion extending in the longitudinal direction of the support means and connected to that section of the latter which in use is closer to the mine face than the other section. This construction will assure that, during advance of the support means, the loose rock produced during operation of the machine will be automatically moved by means of the ramps, arranged in front of the mine face, onto the two wings of the conveyor means, from where the rocks are then transmitted to the elongated portion of the conveyor means which extends in the longitudinal direction of the support means. Since the loading and conveyor means is connected to the support means it will advance together with the same.

The transporting means for the support frames comprise according to the present invention an outrigger which is movable along the conveyor means as well as tiltable with respect thereto. The outrigger is preferably mounted on a carriage, provided with its own drive and turnable with respect to the carriage about a vertical axis and by means of cylinder-and-piston means tiltable in vertical direction with respect thereto. A movable claw is arranged on the free end of the outrigger by means of which parts of the support frame, for instance preassembled on an assembling table arranged at the rear end of the support means, may be picked up and transported through the arched frames of the support means to the region of the mine face. The movability of the outrigger and the claw connected thereto permits to turn the parts of the support frames at the mine face and to place the same against the side walls of the mine gallery without requiring any further means. Since the outrigger is movable on the conveyor means and the latter connected to the section of the support means adjacent the mine face, it is also not necessary to elongate the guide means for the outrigger during advance of the machine. It thereby becomes unnecessary to provide on the walls of the mine gallery additional rails which must be extended corresponding to the advance of the mine gallery. Such additional guide rails are usually quite heavy and the extension thereof, necessary with methods according to the prior art, usually requires time consuming and difficult manual labor. An additional advantage consists in that the conveyor means projects rearwardly beyond the arched frame means of the support means and can thus be overlapped by a monorail on which the parts of the support frames may be transported to the assembly table.

According to the invention it is further advantageous that the positioning means comprise tilt arms, each movably connected at one of the ends thereof to the front end of the section adjacent to the mine face and projecting forwardly therefrom and claw means connected to the free end of each tilt arm for receiving a support frame from the claw means of the transporting means. After transfer of the support frames from the claw means of the transporting means to the claw means of the positioning means the carriage of the transporting means and the outrigger thereon can move again back to the assembly table. Subsequently hereto, the moving means between the two sections of the support means are operated so as to move the section adjacent to the mine face towards the latter to thereby place the support frame into the contour groove. Subsequently thereto the frame will be braced against the surrounding rock.

The support frames of the present invention, for carrying out the aforementioned discussed method, preferably consists of at least four bow-shaped segments, means connecting the segments in pairs to each other to form support frame halves, in which the connecting means comprise clamps respectively connected to the segment pairs and length adjustable means connected to and extending between the clamps for moving the segments of each pair relative to each other, and in which automatic coupling means are provided on those end portions of the segment pairs, which in use are located at the roof of the mine gallery, for connecting the segment pairs to each other.

In a support frame which comprises four segments, two segments are connected to each other by the clamps and the length adjustable stretch unit and means are further provided thereon for connecting one support frame to an adjacent one. The length adjustable stretch means which preferably comprise hydraulically operated cylinder-and-piston means remain thereby in the collapsed position. After the two frame halves are transported in the mentioned manner and positioned into the contour groove, the stretch means on the two frame halves are actuated, whereby the segments of each frame half are moved relative to each other. Since automatic coupling means are provided on the end portions of the roof segments, an automatic coupling of the two frame halves occurs during operation of the stretch means. After the active setting of the frame halves, overload safety means provided on the stretch means will limit movement of the sections relative to each other. The resistance of movement of the segments relative to each other is assured, after the clamps between the two segments of each half are tightened and the stretch unit is removed, by the frictional contact of the segments of trough-shaped cross-section. The means for connecting adjacent support frames to each other are, during advance of the frame halves toward the mine face, aligned with the latter. Only after a support frame is properly placed and braced in the groove formed in the mine face, the means for connecting adjacent support frames to each other on the support frame in the groove of the mine face are connected in a tension and pressure resistant manner to a support frame adjacent thereto which has been previously erected.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 3:
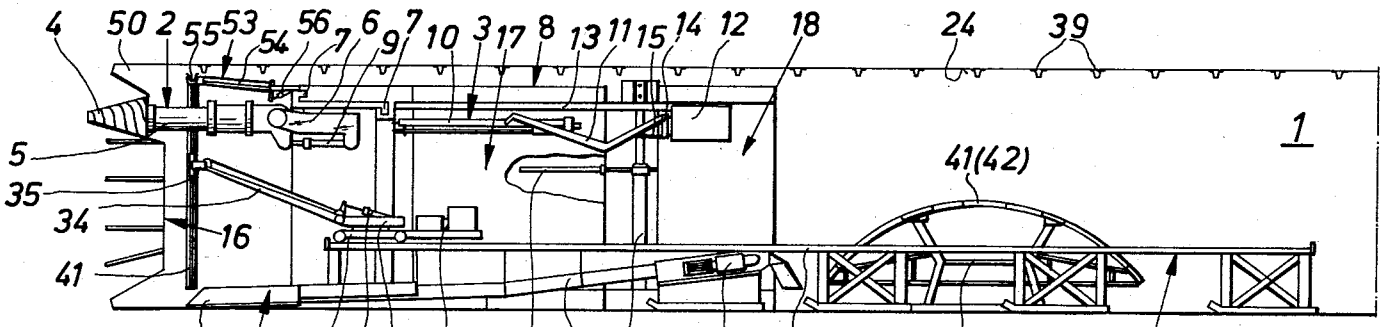
FIG. 3 corresponds to FIG. 1, but shows various elements of the machine in positions different from those shown in FIG. 1.
Figure 4:
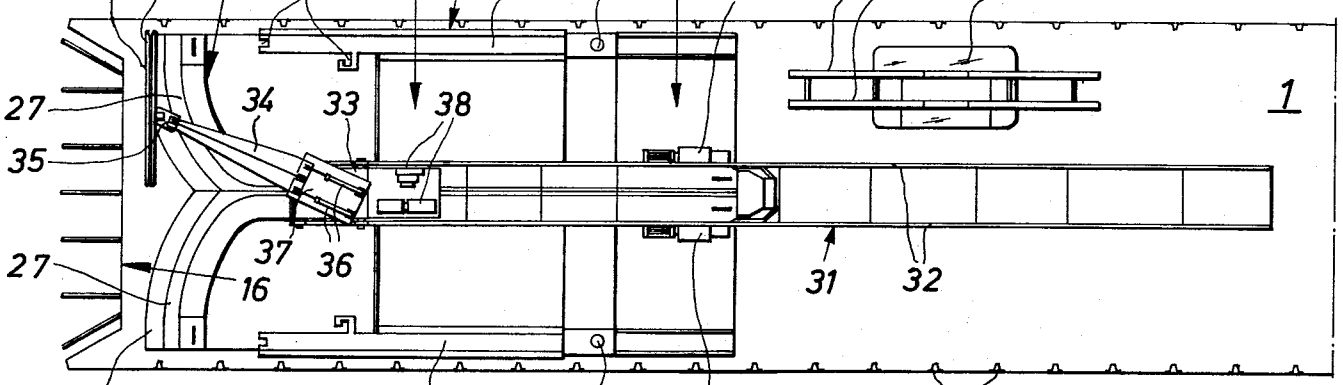
FIG. 4 is a horizontal section according to FIG. 3.
Figure 5:
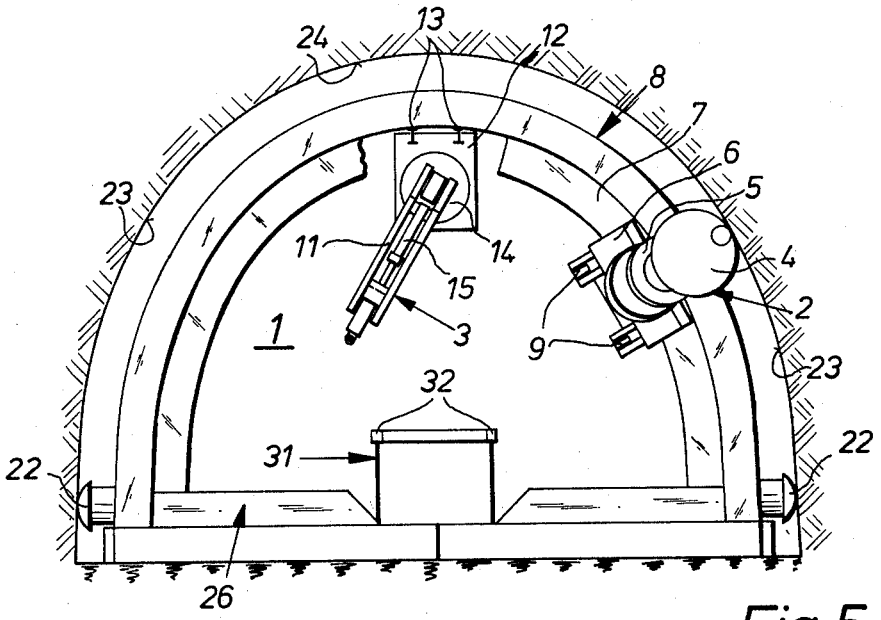
FIG. 5 is a vertical cross-section taken along the line V—V of FIG. 1.
Figure 6:
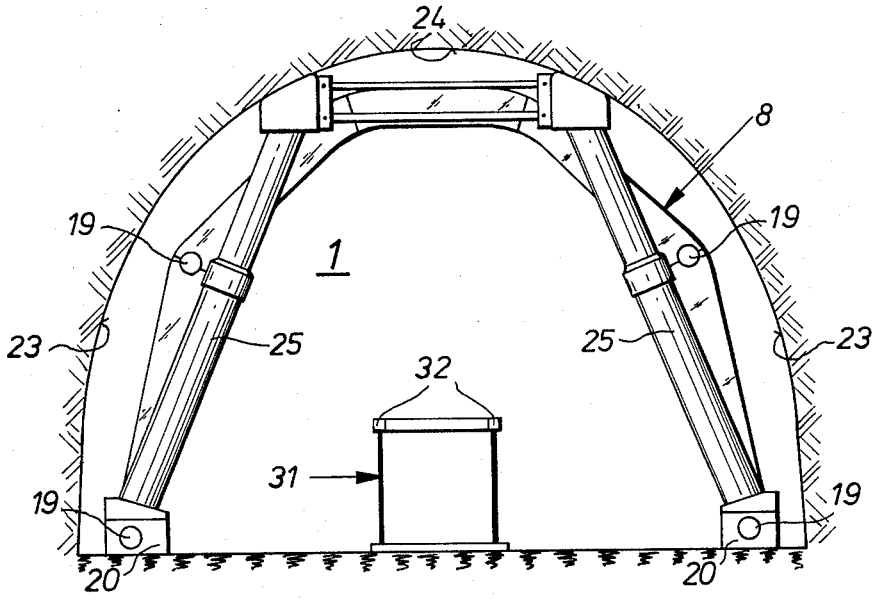
FIG. 6 is a vertical cross-section taken along the line VI—VI of FIG. 1.

The end portion 1 of an underground mine gallery shown in FIGS. 1–4 has a substantially U-shaped cross-section, as can be seen from FIGS. 5 and 6. The advance of the mine gallery is carried out by combined method steps by means of a cutting unit 2 and a boring unit 3 with a subsequent blasting operation.

The cutting unit 2 comprises a substantially conical milling cutter 4 which is mounted on the free end of a cantilever 5. The cantilever 5 is connected at its other end turnable and tiltable to a support member 6, which in turn is movable along guide means 7 provided on a front portion of arch-shaped frame means forming part of support means 8. Means, preferably in the form of fluid operated cylinder-and-piston means 8 are arranged between the support member 6 and the cantilever 5 for tilting the latter relative to the support member, whereas turning of the cantilever is produced by means of hydraulically operated turning means of known construction which may be arranged within the support member 6 and be connected to the cantilever in a known manner.

The boring unit 3 or bore holes forming means preferably comprise a boring tool, telescopic mounting means 10 carrying the boring tool, a slide 12 and a carrier arm 11 connecting the mounting means to the slide. The slide 12 is suspended on guide rails 13 provided on an upper portion of the arched support frames of the support means 8, as best seen in FIG. 5. The turning axis of the carrier arm 11 extends in the longitudinal direction of the mine gallery. Hydraulically operated cylinder-and-piston means 15 are incorporated between the carrier arm 11 and a connecting plate 14 on the slide, by means of which the boring unit 3 may be adjusted relative to the mine face 16.

The support means 8 comprises two coaxially arranged sections 17 and 18, each provided with a pair of transversely spaced wide skids 20 engaging the sole of the mine gallery. Extensible and collapsible cylinder-and-piston means 19 (FIGS. 1, 3 and 6) respectively extending between the sections 17 and 18 in the region of the skids 20, as well as in the medium height region of the arched frames connected thereto, serve to move the sections 17 and 18 relative to each other in the longitudinal direction thereof. A pair of guide rails 21, to which the sections 17 and 18 are slidably connected, serve to maintain the latter coaxial with each other during relative movement thereof (FIGS. 2 and 4). The section 17 adjacent to the mine face 16 may be held stationarily by means of hydraulically operated thrust pistons 22 which project laterally to opposite sides thereof and are adapted to engage during operation side walls 23 of the mine gallery (FIGS. 2 and 5). By feeding different amounts of pressure fluid into the cylinders in which the thrust pistons 22 are slidably guided, it is possible to include the support means relative to the longitudinal direction of the mining gallery. The rear section 18 may be held stationarily by V-shaped arranged hydraulically operated extensible and collapsible props 25 projecting upwardly from the skids 20 and adapted to engage with the upper ends thereof the roof 24 of the mine gallery.

Substantially T-shaped loading and conveyor means 26 are further provided on the support means in the region of the sole of the mine gallery. The loading and conveyor means 26 may for instance comprise a scraper chain conveyor having at the front end thereof two laterally extending wings 27, provided with forwardly extending loading ramps 28, by means of which loose rocks produced during the mining operation will be loaded during advance of the support means 8 onto the wings 27 of the conveyor means 26, to be transported onto the centrally located rising portion 29, from where it passes over a further conveying means, not shown in the drawing, which extends in the longitudinal direction of the mine gallery. The scraper chain conveyor 26 is driven by drive means 30, schematically shown in FIGS. 1–4.

The conveyor 26 has in the region of the support means 8 a frame 31 connected to the front section 17 for movement therewith. The frame 31 extends up to the neighborhood of the front end of the support means 8. The frame 31 is provided at the upper portion thereof with rails 32 on which an outrigger carriage 33 is longitudinally movable. The carriage 33 has a liftable and tiltable outrigger 34 carrying at the free end thereof a movable claw 35. Lifting and lowering of the outrigger 34 is accomplished by hydraulically operated cylinder-and-piston means 36 arranged between the outrigger 34 and a platform 37 turnably arranged on the carriage 33. Drive means 38, provided on the carriage 33, serve to move the latter along the rails 32.

Figure 8:
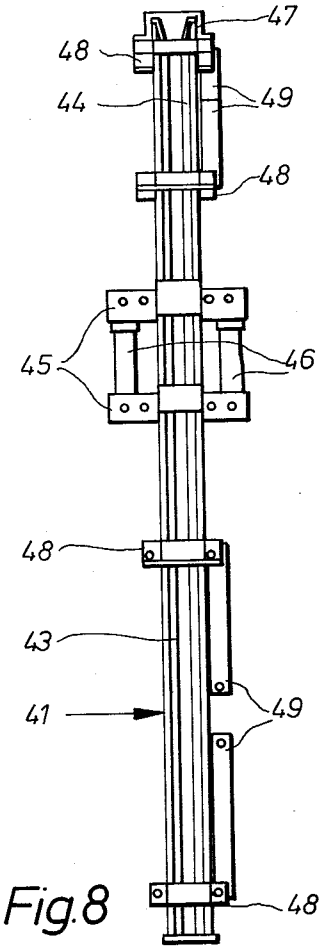
FIG. 8 is a front view of the support frame shown in FIG. 7.
Figure 7:
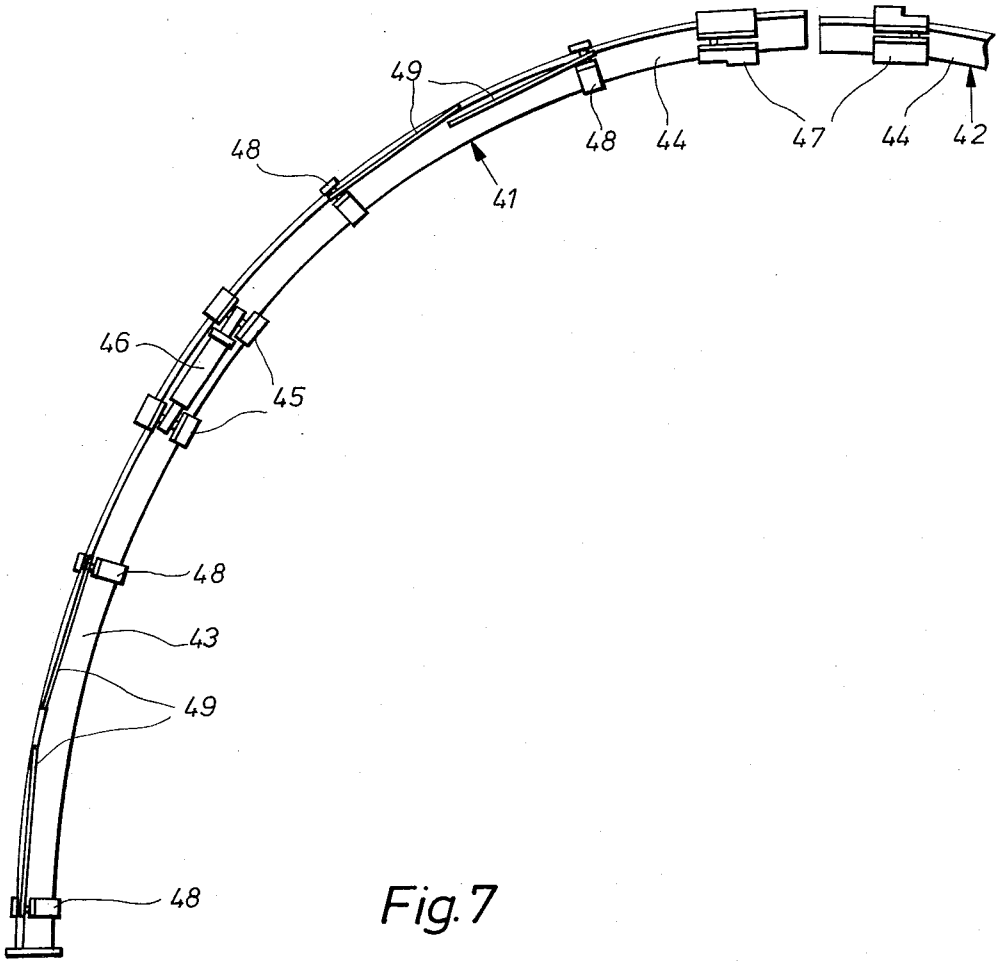
FIG. 7 illustrates part of a supporting frame in side view.

The mine gallery 1 is supported by support frames 39 which are spaced in longirudinal direction of the mine gallery from each other. Each of the support frames 39 is composed of four segments of trough-shaped cross-section. The segments for each support frame are preassembled to support frame halves 41 and 42 on an assembly table 40 arranged rearwardly of the support means 8. As shown in FIGS. 7 and 8, each of the support frame halves is composed of a side segment 43 and a roof segment 44. The segments 43 and 44 are coupled together by clamps 45 and hydraulically operated cylinder-and-piston means 46 arranged therebetween. At the free ends of the roof segments 44 coupling elements 47 are provided which, during setting of the support frames 39, automatically engage each other. As further shown in FIGS. 7 and 8 connecting clips 48 provided with connecting straps 49 are fastened to the segments 43 and 44 for connecting a newly placed support frame 39 to a support frame already previously set in place.

Figure 1:
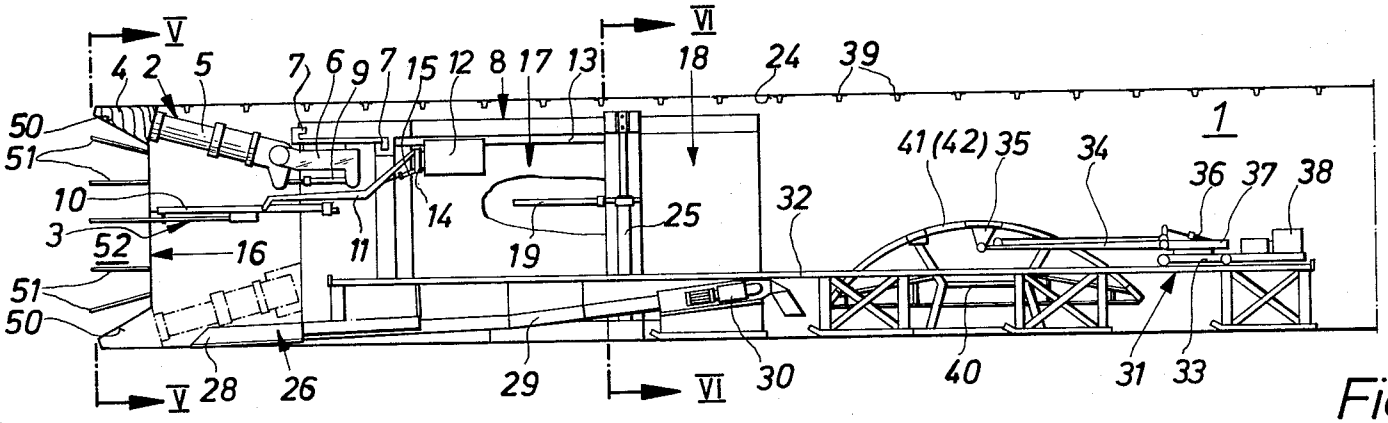
FIG. 1 schematically illustrates a vertical cross-section through part of a mine gallery adjacent to the mine face as well as a machine for advancing and supporting the mine gallery.
Figure 2:
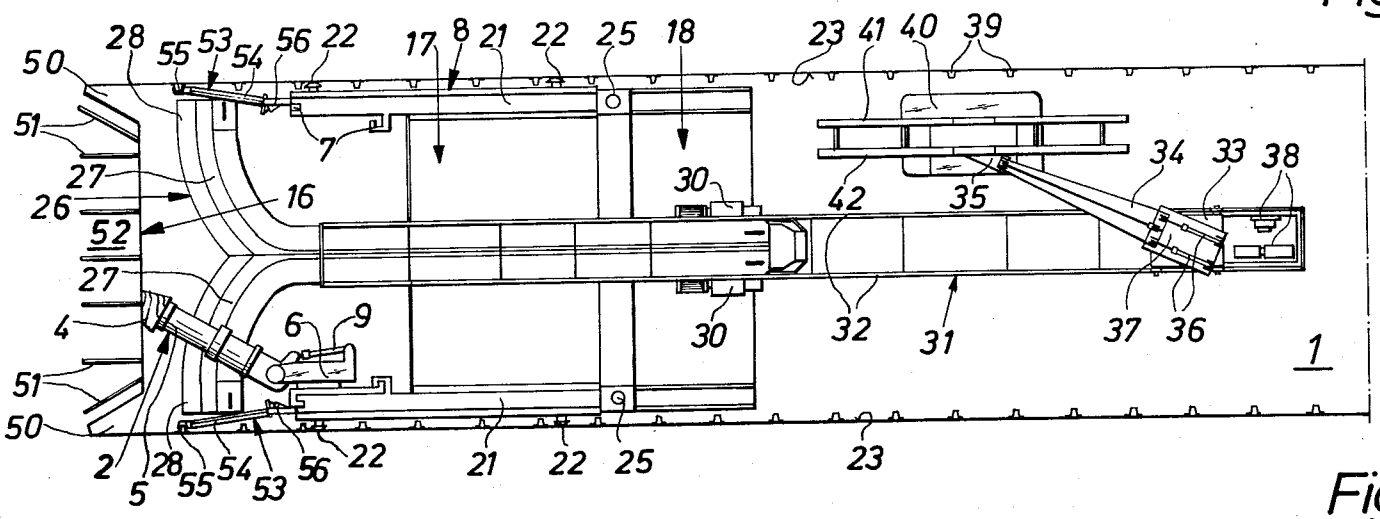
FIG. 2 is a horizontal section of the arrangement shown in FIG. 1.

The above-described arrangement will be operated as follows:

At the beginning of the operation, a contour groove 50 is first machined into the mine face 16 by means of the milling cutter 4, as shown in FIGS. 1 and 2, in which the groove is made with a depth substantially equal to the distance between two successive support frames 39 and with a width greater than the height of a profile of a support frame. Simultaneously with this operation, a plurality of bore holes 51 is drilled in the portion 52 of the mine face 16 located inwardly of the contour groove 50. The loose rock created during formation of the contour groove 50 and the bore holes 51 are transported away from the mine face by the conveyor 26. The contour of the mine gallery cross-section along the side walls 23 and the roof portion 24 is produced by the guide 7 of the support member 6. The section of the groove 50 along the sole of the mine gallery will be produced (see FIG. 1 the position of 4 and 5 shown in dashed-dot lines, as well as FIG. 2), by moving the cantilever 5 in the lowest position of the support member 6 by the cylinder-and-piston means 9 toward the longitudinal axis of the mine gallery and then back again to the side wall 23 and by carrying out this operation from both side walls of the mine gallery.

While the contour groove 50 and bore holes 51 are formed, the two halves 41 and 42 of a support frame are preassembled on the assembly table 40. Subsequently thereto the two halves are transported by means of the outrigger 34 toward the mine face 16 and are there, as shown in FIGS. 2 and 3, respectively placed against the side walls 23 of the mine gallery. From there they are taken over by positioning means 53 (FIGS. 2 and 3), which respectively comprise a tilt arm 54 with a claw 55 mounted at its free end for receiving the respective support frame half. One or two tilt arms may be provided on each side of the mine gallery. The tilt arms 54 are tiltable relative to the support means 8 by hydraulically operated cylinder-and-piston means 56 respectively extending between the tilt arms 54 and the support means 8.

After the support frame halves 41 and 42 are received by the positioning means 53 the outrigger carriage 33 is moved back to its starting position. Subsequently thereto the advancing means 19 between the sections 18 and 19 of the support means 8 are actuated, so that the frame halves 41 and 42 are moved into the contour groove 50. Subsequently thereto, the cylinder-and-piston means 46 between the respective segments 43 and 44 of the support frame halves are actuated so that the coupling elements 47 respectively provided on the roof segments 44 engage with each other. By feeding further pressure fluid into the cylinder-and-piston means 46, the support frames 39 in the contour groove 50 are tightly pressed against the surrounding rock. Subsequently thereto, the connecting clamps 45 at the overlapping portions of the segments 43 and 44 are tightened and the cylinder-and-piston means 46 are removed so that the segments of the support frame 39 are held by friction provided by the clamps against movement with respect to each other.

After a support frame is properly braced in the contour groove 50, the bore holes 51 are filled with explosives which are subsequently exploded to thereby remove the part of the mine face 16 located inwardly of the contour groove 50. The machine is then advanced whereby the loose rocks produced during the preceding operation are transported rearwardly, and subsequently thereto the above-described operations are repeated.

It will be understood that each of the elements described above, or two or more together, may also find a useful application in other types of methods and machines for advancing and supporting an underground mine gallery, differing from the types described above.

While the invention has been illustrated and described as embodied in a method and machine for advancing and supporting an underground mine gallery, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for advancing and supporting an underground mine gallery in which the contour of the gallery cross-section is produced by a mining machine and the gallery cross-section is supported by profiled support frames spaced in longitudinal direction of said mine gallery from each other, said method comprising the steps of producing in the mine face along the contour of the cross-section of the mine gallery a groove having a depth corresponding substantially to the distance between two frames and a width greater than the height of the profile of a frame; simultaneously drilling into the part of the mine face located inwardly of the groove a plurality of bore holes, while transporting at the same time loose material produced by the aforementioned operations away from the mine face; placing a support frame into the groove; bracing the support frame against the surrounding wall surface; connecting the newly placed support frame to a support frame previously placed into the mine gallery; placing explosives into said bore holes; exploding the explosives to remove the part inwardly of the groove from the mine face, while transporting loose material produced by the last step away from the mine face; advancing the machine in longitudinal direction of the mine gallery; and repeating all of the above-mentioned steps.

2. A machine for advancing an underground mine gallery of predetermined contour and for supporting the wall of the latter by support frames spaced in the longitudinal direction of the mine gallery from each other, said machine comprising advanceable and arrestable elongated support means extending in the longitudinal direction of the mine gallery and including frame means arched according to the contour of the mine gallery; groove forming means movably carried by said support means for cutting into the mine face a groove of predetermined width and depth along the desired contour of the mine gallery; guide means on said arched frame means for guiding said groove forming means along the desired contour; bore hole forming means; means connecting said bore hole forming means to said support means for locating said bore hole forming means at portions of the mine face located inwardly of the groove formed by said groove forming means and for advancing said bore hole forming means into said mine face; loading and conveyor means connected to a region of said support means adjacent to the sole of the mine gallery for transporting loose material produced during operation of the machine in the longitudinal direction of the mine gallery away from the mine face; movable means for transporting support frames toward the mine face; and means on the support means for positioning said support frames into the groove formed by said groove forming means.

3. A machine as defined in claim 2, wherein said groove forming means comprises a substantially conical milling cutter, a cantilever carrying at one end thereof said milling cutter, a support member to which the other end of said cantilever is turnably and tiltably connected, means between said support member and said other end of said cantilever for tilting the latter relative to said support member, and guide means on the end of said support means which is directed toward the mine face for guiding the support member along a predetermined path.

4. A machine as defined in claim 2, wherein said bore hole forming means comprise a boring tool, telescoping mounting means carrying said boring tool, a slide, guide means connected to an upper portion of said arched frame on which said slide is suspended movable in longitudinal direction of said support means, and a carrier arm turnable about an axis parallel to said direction, and tiltable with respect to said axis, and means connecting said mounting means to said slide.

5. The machine as defined in claim 2, wherein said transporting means for said support frames comprise a carriage movable along said conveyor means, an outrigger projecting beyond said carriage, means connecting one end of said outrigger to said carriage for moving the other end in three directions relative to said carriage, and claw means connected to the other end of the outrigger for releasably holding a support frame.

6. A machine as defined in claim 2, wherein each of said support frames comprises at least four bow-shaped segments, means connecting said segments in pairs in slightly overlapping relationship to each other to form support frame halves, said connecting means comprising clamps respectively connecting said segments of each pair and length adjustable means connected to and extending between said clamps, and automatic coupling means on end portions of said segment pairs which in use are located at the roof of the mine gallery, for connecting said segment pairs to each other.

7. A machine as defined in claim 2, wherein said support means comprises two coaxially arranged sections movable with respect to each other in said longitudinal direction, a pair of transversely spaced wide skids on each of said sections, extensible and collapsible cylinder-and-piston means connecting said sections to each other for moving the same relative to each other in said direction, and thrust means on each of said sections movable between an active position engaging a portion of the surrounding wall of said mine gallery and an inactive position for maintaining in said active position one of said sections stationarily while the other section is moved relative thereto.

8. A machine as defined in claim 7, wherein said loading and conveyor means is substantially T-shaped having two laterally extending wings at a front end portion thereof provided with forwardly extending loading ramps and an elongated portion extending in the longitudinal direction of said support means and connected to that section of the latter which in use is closer to the mine face than the other section.

9. A machine as defined in claim 7, wherein one of said sections of said support means which is in use is closer to the mine face than the other of said sections has a front end, and wherein said positioning means comprise tilt arms, each connected at one end to said front end of said one section and projecting forwardly therefrom and claw means connected to the other end of each tilt arm for receiving a support frame from said claw means of said transporting means.

10. A machine as defined in claim 7, wherein one of said sections is in use closer to the mine face than the other section, and wherein said thrust means on said one section comprise hydraulically operated cylinder-and-piston means respectively projecting laterally from opposite sides of said one section and having pistons adapted to engage with outer ends thereof side wall portions of the mine gallery, and wherein said thrust means on said other section comprise extensible and collapsible props respectively connected at the lower ends thereof to said skids on said other section and projecting upwardly from the latter inclined towards each other to engage with upper ends thereof the roof of the mine gallery.

* * * * *